US011547165B2

(12) United States Patent
Martin et al.

(10) Patent No.: US 11,547,165 B2
(45) Date of Patent: Jan. 10, 2023

(54) HAIR CAP

(71) Applicants: Leondra Martin, Lithonia, GA (US); Bianca Rush, McDonough, GA (US)

(72) Inventors: Leondra Martin, Lithonia, GA (US); Bianca Rush, McDonough, GA (US)

( * ) Notice: Subject to any disclaimer, the term of this patent is extended or adjusted under 35 U.S.C. 154(b) by 165 days.

(21) Appl. No.: 16/812,272

(22) Filed: Mar. 7, 2020

(65) Prior Publication Data

US 2020/0205497 A1 Jul. 2, 2020

Related U.S. Application Data

(63) Continuation of application No. 14/282,139, filed on May 20, 2014, now abandoned.

(51) Int. Cl.

| | |
|---|---|
| ***A42B 1/049*** | (2021.01) |
| ***A42B 1/12*** | (2006.01) |
| ***A45D 20/00*** | (2006.01) |

(52) U.S. Cl.

CPC ..... *A42B 1/12* (2013.01); *A42B 1/049* (2021.01); *A45D 20/00* (2013.01)

(58) Field of Classification Search

CPC ..... A42B 1/006; A42B 1/049; A42B 1/041; A42B 1/04; A45D 8/40; A45D 44/08

See application file for complete search history.

(56) References Cited

U.S. PATENT DOCUMENTS

| | | | | | |
|---|---|---|---|---|---|
| 1,521,149 | A | * | 12/1924 | Clarizio | A45D 8/40 132/274 |
| 1,618,297 | A | * | 2/1927 | Reinhold | A45D 8/40 132/274 |
| 1,726,936 | A | * | 9/1929 | Turgeon | A42B 1/18 2/175.6 |
| 2,263,418 | A | * | 11/1941 | Ganim | A42B 1/041 2/204 |
| 2,279,867 | A | * | 4/1942 | Falk | A45D 8/40 132/274 |
| 2,336,192 | A | * | 12/1943 | Rouse | A44B 1/12 24/114.7 |
| 2,497,892 | A | * | 2/1950 | Klar | A42B 1/12 2/68 |
| 2,568,399 | A | * | 9/1951 | Kahn | A42B 1/045 2/174 |

(Continued)

*Primary Examiner* — Jillian K Pierorazio

(74) *Attorney, Agent, or Firm* — Robert L Protheroe

(57) ABSTRACT

Implementations of a hair cap are provided. In some implementations, a hair cap may be used to protect the hair of a wearer while they sleep and/or shower. In some implementations, a hair cap comprises a head portion, a pocket portion, and an opening. In some implementations, there may be an elastic band located about the periphery of the opening. In this way, the material about the opening of the head portion may be pulled against a wearer's scalp to potentially prevent water or other liquids from entering the interior of the hair cap. In some implementations, a fastener may be provided on the head portion and another fastener on the pocket portion of a hair cap. In this way the distal end of the pocket portion may be attached to the head portion thereby holding a wearer's hair off of their shoulders and back. In some implementations, silk may be used to manufacture the hair cap. In this way, the wearer's hair is protected from breakage.

16 Claims, 3 Drawing Sheets

(56) References Cited

U.S. PATENT DOCUMENTS 2,698,944 A * 1/1955 Ramsby ..... A41D 15/00 2/174
3,298,035 A * 1/1967 Gobins ..... A45D 8/40 2/174
RE30,899 E * 4/1982 Kallman ..... A45F 5/02 24/3.3
4,683,596 A * 8/1987 Cole ..... A42B 1/12 2/174
5,007,115 A * 4/1991 Denbow ..... A41D 23/00 2/202
5,286,112 A * 2/1994 Bible ..... A45C 13/10 24/442
5,365,613 A * 11/1994 Henegan ..... A42B 1/041 2/174
5,490,528 A * 2/1996 Day ..... A42B 1/04 132/200
5,540,512 A * 7/1996 Pinzauti ..... B42F 13/0026 402/79
5,566,689 A * 10/1996 Yeater ..... A45D 44/08 2/202
5,581,815 A * 12/1996 Hans ..... A41D 13/0015 2/244
D381,790 S * 8/1997 Harris ..... D2/865
5,708,982 A * 1/1998 Armani ..... A45D 8/40 2/171
5,864,887 A * 2/1999 Kozawa ..... A45D 8/40 2/202
5,890,229 A * 4/1999 Esposito ..... A42B 1/006 2/174
D412,234 S * 7/1999 Cox ..... D2/867
6,330,721 B1 * 12/2001 Wallace ..... A42B 1/12 2/174
6,427,251 B1 * 8/2002 Leach ..... A42B 1/041 2/174
6,665,876 B1 * 12/2003 Newman ..... A42B 1/045 2/59
D486,622 S * 2/2004 Matsuda ..... D2/867
7,322,068 B1 * 1/2008 Kim ..... A47K 10/02 24/3.12
7,412,729 B1 * 8/2008 McGovern ..... A42B 1/041 2/174
7,836,522 B2 * 11/2010 Blecha ..... A42B 1/045 2/207
2003/0200594 A1 * 10/2003 McGreggor ..... A42B 1/049 2/202
2006/0005297 A1 * 1/2006 Blecha ..... A42B 1/045 2/207
2007/0056079 A1 * 3/2007 Didier ..... A42B 1/041 2/171
2008/0010721 A1 * 1/2008 Campbell ..... A42C 5/02 2/181.4
2010/0299807 A1 * 12/2010 Saito ..... A42B 1/041 2/174
2012/0030858 A1 * 2/2012 Duffin ..... A42B 3/0406 2/183
2012/0079643 A1 * 4/2012 Clarke ..... A42B 1/049 2/171
2014/0208482 A1 * 7/2014 Asbury ..... A42B 1/18 2/172
2017/0042268 A1 * 2/2017 Lessard ..... A42B 1/041

* cited by examiner

HAIR CAP

RELATED APPLICATIONS

This application is a continuation of, and claims the benefit of, copending U.S. application Ser. No. 14/282,139, filed May 20, 2014, which is hereby incorporated by reference in its entirety herein.

TECHNICAL FIELD

This disclosure relates to implementations of a hair cap.

BACKGROUND

Hair caps may be used to protect a wearer's hair while they sleep and/or shower. They are generally configured to fit over a person's head and at least a portion of their hair.

U.S. patent application Ser. No. 13/248,486 ("'486 patent") discloses a hair cover for protecting long, v-shaped hair while a wearer is sleeping. The hair cover is comprised of two fabric chambers, one dome-shaped for receiving a wearer's head and the other V-shaped for receiving V-shaped hair. The '486 patent discloses that an elastic band can be secured to a periphery of an opening into the dome-shaped chamber of the hair cover to secure it on a wearer's head.

However, the hair cover disclosed in the '486 patent does not provide a way for a wearer to lift their long hair off of their shoulders and/or back. Thus, among other uses, the hair cover disclosed in the '486 patent is not suitable for use while showering. Furthermore, a wearer cannot keep their long hair off of their shoulders and/or back while they sleep.

DETAILED DESCRIPTION

Implementations of a hair cap are provided. In some implementations, a hair cap may be used to, for example, protect the hair of a wearer while they sleep and/or shower. In some implementations, a hair cap comprises in some implementations, a hair cap comprises a head portion having an opening therein, a pocket portion, a band secured about the periphery of the opening, a first fastener on the head portion and a second fastener on the pocket portion. In some implementations, the second fastener may be located on a distal portion of the pocket portion. In some implementations, the first fastener may be configured to mate with the second fastener. In this way, the distal end of the pocket portion may be attached to the head portion thereby lifting a wearer's hair off of their shoulders and back. Thus, in some implementations, the hair cap may be used to protect the hair of a wearer while they sleep and/or shower.

Figure 1:
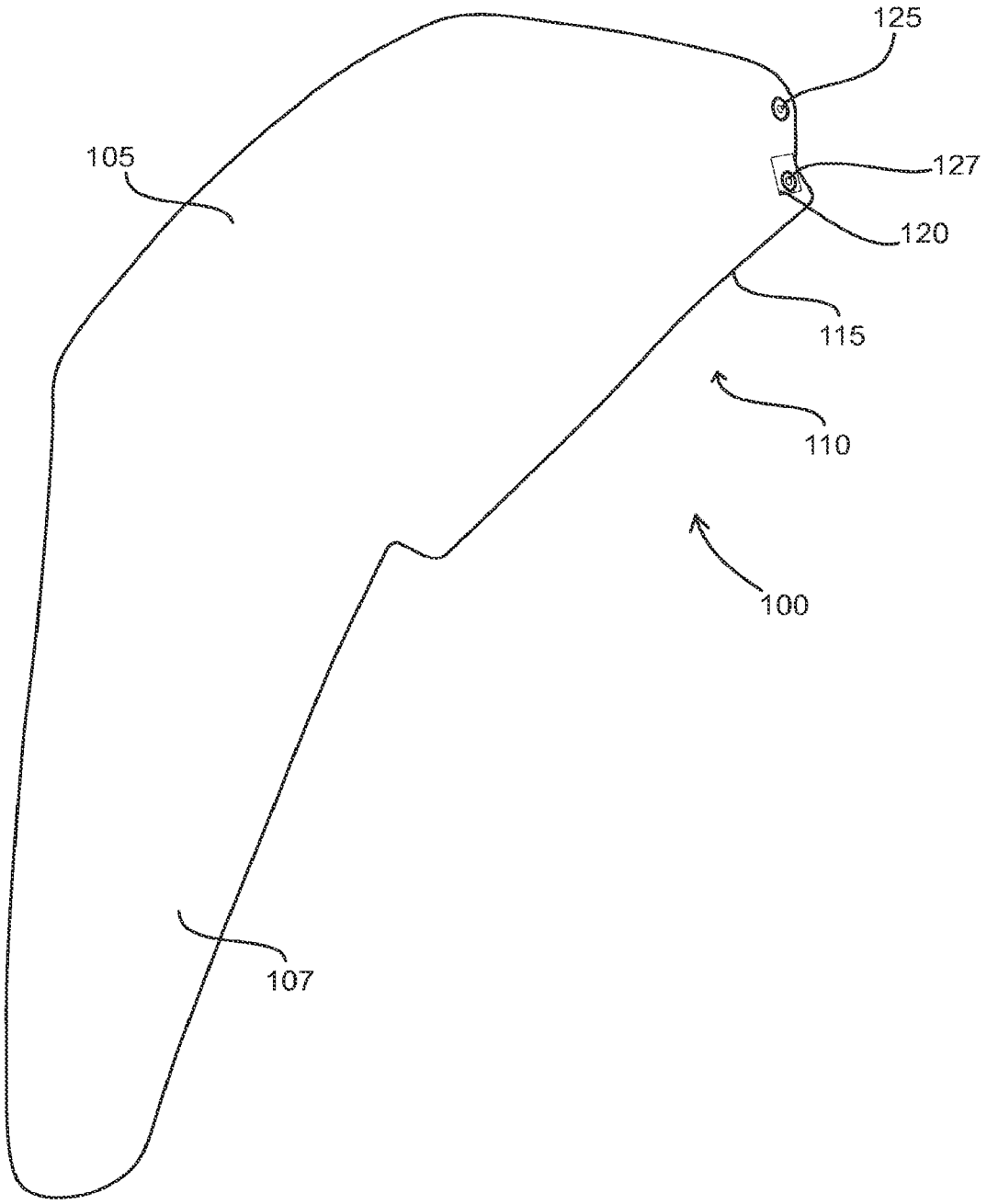
FIGS. 1-2 illustrate an example hair cap according to the present disclosure.
Figure 2:
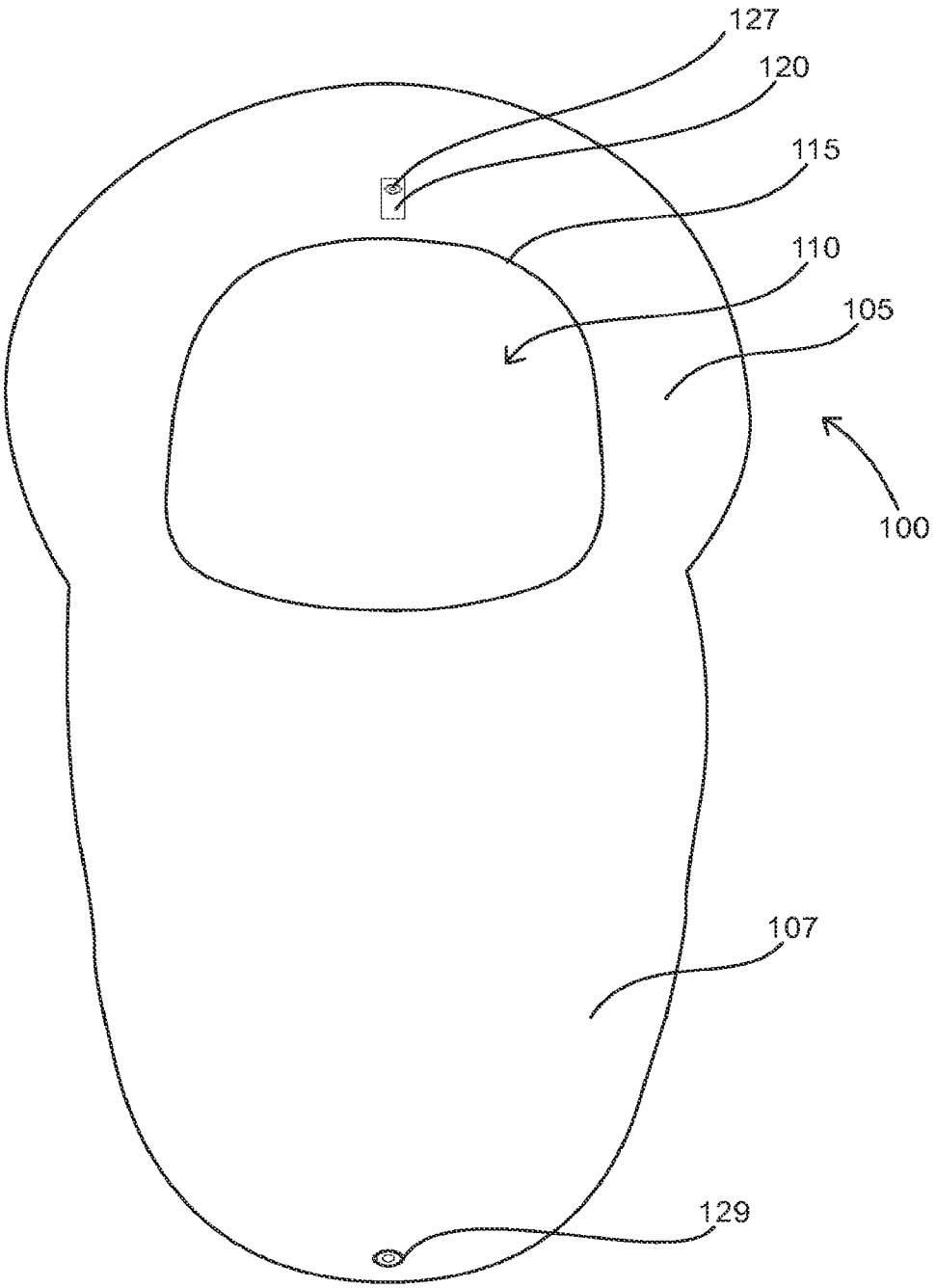

FIGS. 1-2 illustrate an example hair cap 100 according to the present disclosure. As shown in FIGS. 1-2, in some implementations, a hair cap 100 comprises a head portion 105 having an opening 110 therein, a pocket portion 107, a band 115 secured about the periphery of the opening 110, a first fastener 125 on the head portion 105 and a second fastener 129 on the pocket portion 107.

In some implementations, the head portion 105 may be configured to fit about a wearer's head. In some implementations, there may be an opening 110 into an interior portion of the hair cap 100 (see, e.g. FIG. 1). In some implementations, there may be an elastic band 115 located about the periphery of an opening 110. In this way, the material about the opening 110 of the head portion 105 may be pulled against a wearer's scalp to help secure the hair cap 100 to the wearer's head and help prevent water or other liquids from entering the interior of the hair cap 100. In some implementations, the elastic band 115 may be secured within a fold of material located about the periphery of the opening 110. In some implementations, the elastic band 115 may be secured about the opening 110 by any suitable method known to one of ordinary skill in the art. In some implementations, there may not be an elastic band 115 located about the periphery of an opening 110. In some implementations, the band 115 may be comprised of a draw string apparatus.

In some implementations, the pocket portion 107 of the hair cap 100 extends from the head portion 105 (see, e.g. FIG. 1). The pocket portion 107 is configured to receive and encase a wearer's hair therein.

Figure 3:
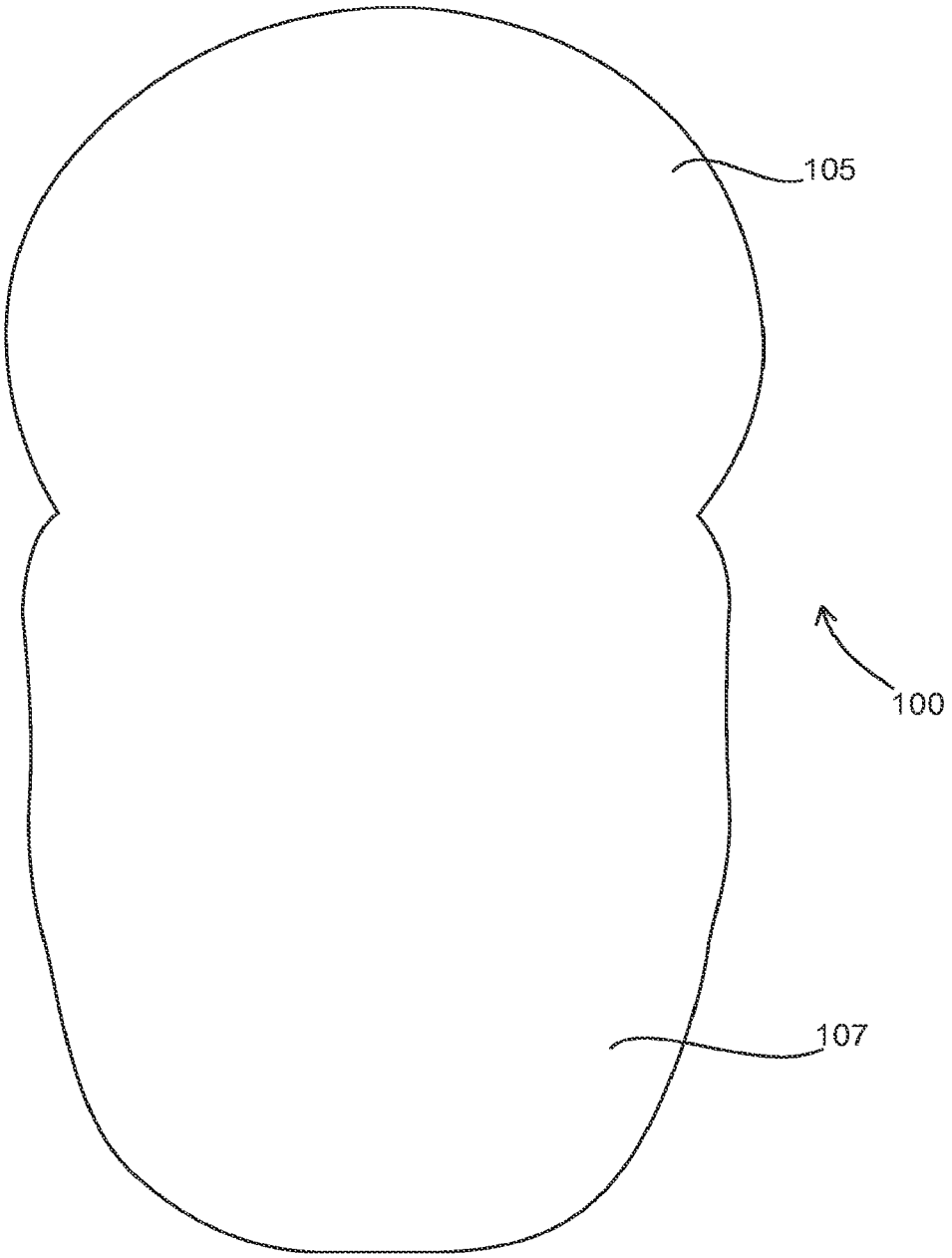
FIG. 3 illustrate another example hair cap according to the present disclosure.

In some implementations, the pocket portion 107 may have a U-shape (FIG. 2). In some implementations, the pocket portion 107 may be generally square with rounded edges (see, e.g., FIG. 3). In some implementations, the pocket portion 107 may be any shape suitable for receiving a wearer's hair therein.

In some implementations, the second fastener 129 may be located on a distal portion of the pocket portion 107 (see, e.g., FIG. 2). In some implementations, the first fastener 125 may be configured to mate with the second fastener 129. In this way, the distal end of the pocket portion 107 may be attached to the head portion 105 thereby lifting a wearer's hair off of their shoulders and back. Thus, in some implementations, the hair cap 100 may be used to protect the hair of a wearer while they sleep and/or shower.

In some implementations, more than one fastener may be located on the pocket portion 107 of a hair cap 100. In some implementations, the fastener 129 may be located on a front side of the pocket portion 107 (see, e.g., FIG. 2). In some implementations, the fastener 129 may be located on a back side of the pocket portion 107. In some implementations, the fastener 129 may be secured to a fastener located on the head portion 105 of a hair cap 100. In some implementations, the fastener 129 may be secured to a tab 120 by a fastener 127.

In some implementations, the hair cap 100 may comprise a first fastener 125 and a third fastener 127 attached to a tab 120 extending from head portion. In some implementations, the first fastener 125 may be configured to mate with the third fastener 127. In this way, the tab 120 may be secured to the first fastener 125 located on the head portion 105 of a hair cap 100 to conceal the first fastener 125 when not in use to the lift the pocket portion 107 and prevent the tab 120 from moving about.

In some implementations, the tab 120 may be shaped like a rectangle. In some implementations, the tab 120 may be any suitable shape. In some implementations, the first fastener 125 or the tab 120 may be located adjacent an opening 110 (see, e.g., FIG. 1). In some implementations, the first fastener 125 and/or the tab 120 may be located near the crown portion of the head portion 105. In some implementations, the first fastener 125 and/or the tab 120 may be located at any suitable position on the head portion 105 or pocket portion 107. In some implementations, the hair cap 100 may comprise a plurality of fasteners and/or tab 120 located in various positions on the head portion 105. In this way, the wearer can position the pocket portion 107 in a desired location based, for example, on the length of the wearer's hair.

In some implementations, the fasteners 125, 127 or fasteners 125, 129 may be snaps (see, e.g., FIGS. 1 and 2), buttons, hook and loop fasteners (e.g., Velcro®), magnets or other reclosable fasteners or any other attachment or fastening technology existing or developed in the future.

In some implementations, a hair cap 100 may be comprised of a single piece of material. In some implementations, a hair cap 100 may be comprised of two or more pieces of material. In some implementations, a hair cap 100 may be comprised of interior and exterior layer(s) of material. In some implementations, the interior and exterior surface may comprise different materials and/or textures. In some implementations, nylon may be used to manufacture a hair cap 100. In some implementations, silk may be used to manufacture a hair cap 100. In this way, the wearer's hair is protected from breakage. In some implementations, silk may be used for the interior portion of the hair cap 100. In some implementations, a hair cap 100 may be manufactured from any material suitable for use as a hair cap 100.

To secure some implementations of the hair cap 100 on a wearer's head, a wearer's hair may be initially fed through the opening 110 into the interior portion of the head portion 105 and pocket portion 107. As the hair cap 100 is pulled up the length of the wearer's hair, the opening 110 of the head portion 105 may be pulled over a portion of the wearer's head and secured in place by the elastic band 115 located about the opening 110. In this way, the wearer's hair is secured within the interior portions of the head portion 105 and pocket portion 107 of the hair cap 100.

In some implementations, once the wearer's hair is secured within the interior of the hair cap 100, the wearer may lift the pocket portion 107 off of their back and/or shoulders by attaching a fastener on the pocket portion 107 (e.g., the second fastener 129) to a fastener on the head portion 105 (e.g., the first fastener 125).

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A hair cap for protecting a wearer's hair, the hair cap comprising:
- a head portion configured to fit about a wearer's head;
- a tab comprising a tab fastener disposed thereon, wherein:
  - the tab is attached to the head portion only along one edge of the tab; and
  - the tab fastener is disposed on a distal portion of the tab (distal from the one edge); and
- a pocket portion extending generally downward from a posterior of the head portion, the pocket portion having a pocket portion fastener, wherein:
  - the pocket portion is configured to receive a wearer's hair therein, wherein a received wearer's hair is generally positioned towards a posterior of the wearer's head; and
  - the pocket portion fastener is configured to be optionally attached to the tab fastener, wherein an optional attachment of the pocket portion fastener to the tab fastener comprises an attachment of an exterior surface of the pocket portion to the tab and locates a distal end of the pocket portion on or proximate to the head portion, wherein:
    - the pocket portion extends generally downward from the posterior of the head portion; and
    - the distal end of the pocket portion is relocated from a generally downward and posterior location from the head portion to a more anterior location to the head portion as a result of the optional attachment.

2. The hair cap of claim 1, wherein the pocket portion fastener is disposed on or about the distal end of the pocket portion.

3. The hair cap of claim 1, wherein the pocket portion comprises a pocket wall continuously circumscribing a perimeter surrounding a long axis of the pocket portion, wherein the pocket wall has an interior surface and an exterior surface.

4. The hair cap of claim 3, wherein the pocket portion fastener is configured to attach the exterior surface of the pocket wall.

5. The hair cap of claim 3, wherein at least a portion of the interior surface of the pocket wall comprises silk.

6. The hair cap of claim 3, wherein the pocket wall protects and fully encases hair received therein without either of a twisting of the pocket wall about the long axis, or an optional attachment of the pocket portion fastener to the tab fastener.

7. The hair cap of claim 3, wherein the pocket portion fastener is configured to be optionally attached to the tab fastener without a twisting of the pocket wall about the long axis.

8. The hair cap of claim 4, wherein the pocket wall comprises an anterior exterior surface of the pocket portion, and the pocket portion fastener is disposed thereon.

9. The hair cap of claim 4, wherein the pocket wall comprises a posterior exterior surface of the pocket portion, and the pocket portion fastener is disposed thereon.

10. The hair cap of claim 1, wherein the pocket portion is U-shaped.

11. The hair cap of claim 1, wherein the pocket portion is square with round edges.

12. The hair cap of claim 1, wherein the head portion comprises an interior surface and at least a portion of the interior surface of the head portion comprises silk.

13. The hair cap of claim 1, wherein the pocket portion comprises an interior surface and at least a portion of the interior surface of the pocket portion comprises silk.

14. The hair cap of claim 1, further comprising a band configured to assist in a securing of the head portion to a head of a wearer, wherein the band is located about a periphery of an opening of the head portion configured to receive a wearer's head.

15. The hair cap of claim 14, wherein the band is an elastic band.

16. A hair cap for protecting a wearer's hair, the hair cap comprising:

a head portion configured to fit about a wearer's head, the head portion comprising:

an exterior surface of the head portion;

a tab comprising a tab fastener disposed thereon, wherein:

the tab is attached to the exterior surface of the head portion only along one edge of the tab; and the tab fastener is disposed on a distal portion of the tab (distal from the one edge);

a head portion opening configured to receive a wearer's head; and a band configured to assist in a securing of the head portion to a head of a wearer, wherein the band is located about a periphery of the head portion opening; and a pocket portion extending generally downward from a posterior of the head portion, the pocket portion comprising:

a pocket wall continuously circumscribing a perimeter surrounding a long axis of the pocket portion, wherein the pocket wall has an interior surface and an exterior surface and the pocket portion is configured to receive a wearer's hair therein, wherein a received wearer's hair is generally positioned towards a posterior of the wearer's head; and a pocket portion fastener, wherein the pocket portion fastener is configured to be optionally attached to the tab fastener, such that an optional attachment of the pocket portion fastener to the tab fastener comprises an attachment of the exterior surface of the pocket wall to the head portion without requiring a twisting of the pocket wall about the long axis, and locates a distal end of the pocket portion on or proximate to the head portion, wherein:

the pocket portion extends generally downward from the posterior of the head portion; and the distal end of the pocket portion is relocated from a generally downward and posterior location from the head portion to a more anterior location to the head portion as a result of the optional attachment.

* * * * *